US009498043B2

(12) United States Patent
Nishimura et al.

(10) Patent No.: US 9,498,043 B2
(45) Date of Patent: Nov. 22, 2016

(54) COSMETICS APPLICATOR

(71) Applicant: TAIKI CORP., LTD., Osaka-shi, Osaka (JP)

(72) Inventors: Muneto Nishimura, Osaka (JP); Yuko Nakanishi, Osaka (JP)

(73) Assignee: TAIKI CORP., LTD., Osaka (JP)

( * ) Notice: Subject to any disclaimer, the term of this patent is extended or adjusted under 35 U.S.C. 154(b) by 0 days.

(21) Appl. No.: 14/383,349

(22) PCT Filed: Mar. 6, 2013

(86) PCT No.: PCT/JP2013/056190

§ 371 (c)(1),
(2) Date: Sep. 5, 2014

(87) PCT Pub. No.: WO2013/133344

PCT Pub. Date: Sep. 12, 2013

(65) Prior Publication Data

US 2015/0020844 A1 Jan. 22, 2015

(30) Foreign Application Priority Data

Mar. 6, 2012 (JP) ..... 2012-049539

(51) Int. Cl.
*A45D 33/34* (2006.01)
*A45D 34/04* (2006.01)
*A45D 40/26* (2006.01)

(52) U.S. Cl.
CPC ..... *A45D 34/04* (2013.01); *A45D 33/34* (2013.01); *A45D 40/26* (2013.01); *A45D 2200/1018* (2013.01)

(58) Field of Classification Search
CPC ..... A45D 34/04; A45D 34/00; A45D 40/26; A45D 40/28; A45D 33/34; A45D 33/38; A45D 2200/1018; A45D 2200/1009; A45D 2200/1054; A45D 2200/1081; A45D 2200/1027; A45D 2200/1036; A45D 7/045; A45D 19/0008; A45D 19/0016; A47L 13/16; A47L 13/17; A47L 13/18; A47L 13/19
USPC ..... 132/320, 317, 318, 108, 221, 222, 73, 132/75.6, 76.4, 218
See application file for complete search history.

(56) References Cited

U.S. PATENT DOCUMENTS 5,567,073 A * 10/1996 de Laforcade ..... A45D 34/04 401/190
5,913,318 A * 6/1999 Gueret ..... A45D 33/34 132/293

(Continued)

FOREIGN PATENT DOCUMENTS

EP 1 541 055 A2 6/2005
EP 2 347 672 A1 7/2011

(Continued)

OTHER PUBLICATIONS

International Search Report mailed by Japan Patent Office on Apr. 9, 2013 in the corresponding PCT Application No. PCT/JP2013/056190—3 pages.

(Continued)

*Primary Examiner* — Rachel Steitz
(74) *Attorney, Agent, or Firm* — Knobbe, Martens, Olson & Bear LLP

(57) ABSTRACT

A cosmetic applicator whose application part has an arithmetic average surface roughness Ra of 10 μm or less is provided, based on a study of the surface roughness of the application part of the cosmetic applicator, to further reduce the amount of cosmetic material accumulating on the surface of the application part, and to more reliably release onto the skin surface the cosmetic material that has been picked up onto the surface of the application part.

6 Claims, 1 Drawing Sheet

(56) References Cited

U.S. PATENT DOCUMENTS 6,006,761 A * 12/1999 Meledandri ..... A45D 33/34 132/317
6,734,220 B2 * 5/2004 Niederoest ..... C08G 18/4072 521/126
7,475,692 B2 * 1/2009 Hartstock ..... A45D 34/042 132/218
7,785,654 B2 * 8/2010 Nabata ..... A61K 8/0208 132/320
7,878,728 B2 * 2/2011 Nasu ..... A45D 34/04 401/173
8,132,575 B2 * 3/2012 Tojo ..... A45D 19/0008 132/270
8,272,801 B2 * 9/2012 Linzell ..... A45D 34/04 15/209.1
8,529,149 B2 * 9/2013 Yun ..... A46B 5/0095 132/320
2002/0146956 A1 * 10/2002 Ngai ..... A47K 7/02 442/381
2008/0302385 A1 * 12/2008 Nakamura ..... A01N 33/12 132/320
2009/0101163 A1 * 4/2009 Brunner ..... A45D 40/0087 132/320
2009/0263153 A1 * 10/2009 Uenda ..... B08B 1/00 399/101
2011/0045306 A1 * 2/2011 Johnson ..... B29C 43/28 428/423.1
2011/0247648 A1 * 10/2011 Ikeda ..... A45D 33/34 132/320
2012/0180808 A1 * 7/2012 Nakamura ..... A45D 33/006 132/320
2013/0189017 A1 * 7/2013 Thiebaut ..... A45D 34/04 401/143
2013/0274762 A1 * 10/2013 Guay ..... A45D 44/22 606/131
2013/0343801 A1 * 12/2013 Sakuma ..... A61K 8/891 401/143
2015/0209243 A1 * 7/2015 Shiroya ..... A61K 8/676 424/401

FOREIGN PATENT DOCUMENTS

JP 04-144505 A 5/1992
JP 06-284924 A 10/1994
JP 2003-192826 A 7/2003
JP 2005-111170 A 4/2005
JP 2006-198217 A 8/2006
JP 2009240412 A * 10/2009
WO WO 2006/018907 A1 2/2006

OTHER PUBLICATIONS

The extended European search report issued by European Patent Office on Oct. 13, 2015 in the corresponding European patent application No. 13757276.4—6 pages.

* cited by examiner

COSMETICS APPLICATOR

This application is the U.S. National Phase under 35 U.S.C. §371 of International Application PCT/JP2013/056190, filed Mar. 6, 2013, which claims priority to Japanese Patent Application No. 2012-049539, filed Mar. 6, 2012. The International Application was published under PCT Article 21(2) in a language other than English.

TECHNICAL FIELD

The present invention relates to a cosmetic applicator such as a tip, sponge, etc.

BACKGROUND ART

Tips, sponges, and other cosmetic applicators for applying powder or liquid cosmetic materials have been widely used.

When such applicators are used continuously, cosmetic material picked up on the application face accumulates, making the surface of the application part look dirty. In addition, such accumulation of cosmetic material on the application face reduces the amount of cosmetic material that can be picked up by the application face during makeup application, and also reduces the amount of cosmetic material released onto the skin surface.

This makes it necessary to perform more release operations during makeup application, compared to when a new applicator is used.

From the viewpoint of hygiene, etc., bacteria grow easily inside the applicator, especially when liquid cosmetic material is applied, because the cosmetic material permeates into the applicator.

Particularly in the case of cream eye shadow or other cream cosmetic material, a normal tip having embossed patterns or porous irregularity on its surface would allow the cosmetic material to enter the concaved parts and prevent it from being released favorably onto the skin surface during makeup application.

In addition, the cosmetic material permeates into such cosmetic applicator after a single use, and therefore using one cosmetic applicator for cosmetic materials of different types, colors, etc., would cause these different cosmetic materials to rise to the surface of the cosmetic applicator and a mixture of cosmetic materials may be released onto the skin surface, thus making it difficult to achieve a desired makeup finish.

This makes it necessary to prepare a cosmetic applicator for each type of cosmetic material, such as cosmetic material of each color, which leads to problems such as having to carry a bulky cosmetic kit.

One known example of such cosmetic applicator is the cosmetic puff described in Patent Literature 1, which has air bubbles formed on its surface in such a way that 90% or more of the air bubbles have a pore diameter of 0.2 to 2 mm, in order to achieve appropriate foundation-holding property. Patent Literature 2 also describes a liquid-cosmetic applicator made of latex foam, but there is no mention of its holding property and release property with respect to cosmetic material.

Patent Literature 3 describes a cosmetic sponge puff made of micro-porous urethane resin obtained from a material mixed with a certain water/oil repellent, and claims that this puff can prevent liquid cosmetic material from being absorbed into the puff.

Patent Literature 4 describes a cosmetic material-supporting layer constituted by a resin film supporting enough cosmetic material to last for several makeup sessions, and claims that, by adjusting the average centerline surface roughness of the layer to a range of 3.5 to 10 μm, drop-out of cosmetic material can be prevented and residues of cosmetic material after scrape-off become less conspicuous; however, what is described in this literature is none other than a free sample powder compact.

BACKGROUND ART LITERATURE

Patent Literatures

Patent Literature 1: Japanese Patent Laid-open No. Hei 4-144505

Patent Literature 2: Japanese Patent Laid-open No. 2003-192826

Patent Literature 3: Japanese Patent Laid-open No. Hei 6-284924

Patent Literature 4: Japanese Patent Laid-open No. 2006-198217

SUMMARY OF THE INVENTION

Problems to Be Solved by the Invention

The cosmetic applicators described in Patent Literatures 1 and 2 above do not prevent cosmetic material from permeating inside or consider how they are released onto the skin surface, but they are designed to simply support cosmetic material in their surface irregularities and release it onto the skin surface.

As mentioned above, when such applicators are used continuously, cosmetic material is picked up onto the surface of the application part and accumulates, making the surface of the application part look dirty. In addition, such accumulation of cosmetic material on the surface of the application part reduces the amount of cosmetic material that can be picked up by the surface of the application part during makeup application, and also reduces the amount of cosmetic material released onto the skin surface.

On the other hand, there are means for enabling continuous applicator use for makeup, such as the invention described in Patent Literature 3 which is a cosmetic sponge puff formed with what has been obtained from a material mixed with a water/oil repellent, so that cosmetic material will not remain on the surface of the sponge puff. However, such sponge puff still has surface irregularity like conventional applicators and a relatively large amount of cosmetic material remains in the concaved parts on the surface of the sponge puff after use.

In light of these situations, the object of the present invention is, based on a study of the surface roughness of the cosmetic applicator, to further reduce the amount of cosmetic material accumulating on the surface of the cosmetic applicator, and to more reliably release onto the skin surface the cosmetic material that has been picked up onto the surface of the cosmetic applicator, and also to allow cosmetic materials of different types to be applied reliably using a single cosmetic applicator.

Means for Solving the Problems

The present invention relates to a cosmetic applicator, as described below, which can support sufficient cosmetic material, while allowing it to be applied in a manner preventing any accumulation of cosmetic material on the surface of the cosmetic applicator to the utmost extent possible, in order to solve the aforementioned objects:

1. A cosmetic applicator whose arithmetic average surface roughness Ra is 10 μm or less.
2. A cosmetic applicator whose maximum surface height Rz is 100 μm or less.
3. A cosmetic applicator according to 1, whose maximum surface height Rz is 80 μm or less.
4. A cosmetic applicator according to any one of 1 to 3, wherein the cosmetic material application part of such cosmetic applicator is constituted by an elastic base.
5. A cosmetic applicator according to any one of 1 to 4, wherein the elastic body is constituted by a sponge or polyurethane foam.
6. A cosmetic applicator according to 4 or 5, wherein a sheet is attached onto the surface of the elastic base.
7. A cosmetic applicator according to 6, wherein the sheet is made of a polyurethane film with a thickness of 15 μm or less.
8. A cosmetic applicator according to any one of 1 to 7, wherein a release ratio obtained by dividing the release amount which is the amount of cosmetic material that has been picked up onto the surface of the cosmetic applicator and subsequently applied to the skin and released onto the skin surface from the cosmetic applicator, by the amount of cosmetic material picked up onto the surface of the cosmetic applicator, is 85% or more.
9. A cosmetic applicator according to any one of 1 to 8, shaped as a tip, puff, or sac into which the fingertip can be inserted.

Effects of the Invention

According to the present invention, achieved are such effects that a sufficient amount of cosmetic material is supported on the surface of the cosmetic applicator regardless of whether the cosmetic material is liquid, powder or cream, and also because the amount of cosmetic material remaining on the cosmetic applicator is reduced to the utmost extent possible once it has been applied to the skin surface, the amount of cosmetic material accumulating on the surface of the cosmetic applicator over continued use is reduced and growth of bacteria in the remaining cosmetic material is prevented.

As a result, cosmetic material can be spread evenly and neatly over the skin surface, and if the cosmetic applicator becomes dirty after use due to pickup of cosmetic material, the picked-up cosmetic material can be easily wiped off using tissues, etc., to restore the original clean surface.

MODE FOR CARRYING OUT THE INVENTION

A favorable mode for carrying out the present invention is explained in specific terms below.

(Cosmetic Applicator)

Figure 1:
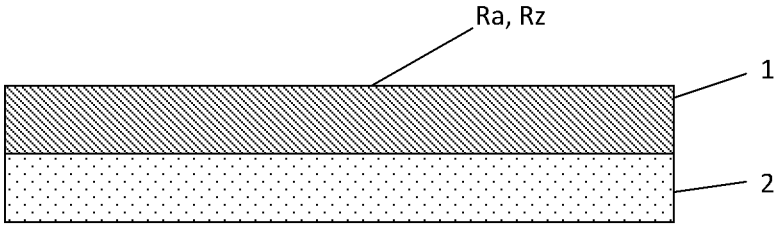
FIG. 1 is a schematic partial sectional view of a cosmetic applicator according to an embodiment of the present invention.
Figure 2:
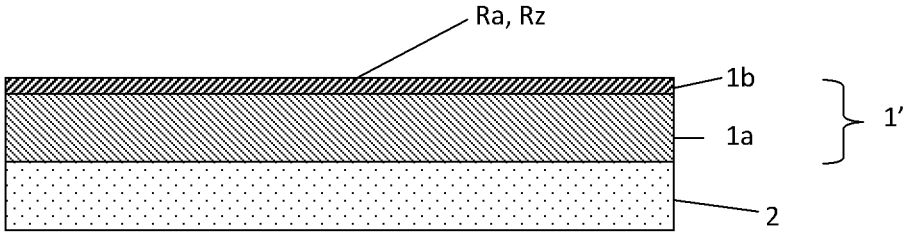
FIG. 2 is a schematic partial sectional view of a cosmetic applicator according to another embodiment of the present invention.

The cosmetic applicator proposed by the present invention includes: a cosmetic applicator formed by a tip for making up the eyes, lips, eyelashes, eyebrows or used for skincare purposes, etc., a sponge or puff for applying foundation, etc., or other traditional material having porous or other surface irregularity; a cosmetic applicator shaped as a sac that is fitted onto the fingertip and thus can be secured at the fingertip for use; or a cosmetic applicator, etc., for applying cheek color, eye shadow, etc.; wherein such cosmetic applicator has a surface layer of a cosmetic material application part constituted by a base (e.g., an elastic base 1 in FIG. 1, whose surface has arithmetic average surface roughness Ra and maximum surface height Rz) supported on a supporting implement (e.g., a supporting implement 2 in FIG. 1) which in turn is supported with the fingers as necessary, or by such base (e.g., an elastic base 1*a* in FIG. 2) whose surface is covered (e.g., by a sheet 1*b* in FIG. 2 whose surface has arithmetic average surface roughness Ra and maximum surface height Rz, wherein the base 1*a* and the sheet 1*b* constitute a cosmetic material application part 1').

In particular, the sac-shaped cosmetic applicator can apply cosmetic material quickly and easily without leaving fingerprints, and because the fingertip is inserted into the sac for use, this cosmetic applicator can be secured at the fingertip.

As for cosmetic materials used, any cosmetic material in powder, liquid, cream, or other form can be applied onto the skin surface and then spread, but it is desirable that the cosmetic applicator be used to apply liquid or cream cosmetic material that can easily permeate into porous cosmetic applicators.

It is also possible to pick up cosmetic material onto the surface of the application part of the cosmetic applicator proposed by the present invention, and then spread the cosmetic material over the skin surface or hairs.

As for the surface roughness of the application part of the cosmetic applicator proposed by the present invention, the arithmetic average surface roughness Ra must be 10 μm or less, or preferably 7.0 μm or less, or more preferably 5.0 μm or less. Or, the maximum height Rz of this surface is 100 μm or less, or preferably 80 μm or less, or more preferably 65 μm or less.

If the arithmetic average surface roughness Ra of the application part exceeds 10 μm, or the maximum height Rz of the surface exceeds 100 μm, a sufficient amount of powder or liquid cosmetic material can be supported, but it becomes difficult to reliably release onto and spread over the skin surface the supported amount of cosmetic material, and consequently on the surface of the application part of the cosmetic applicator, a lot of cosmetic material that cannot be released onto the skin surface will remain. Then, as this cosmetic applicator is used over time, cosmetic material will accumulate, enter the interior from the surface of the application part, and collect there.

(Means for Achieving Specified Ra and Rz)

If the base surface itself is used as the surface of the application part of the cosmetic applicator, then the arithmetic average roughness Ra or maximum height Rz of the base surface must be adjusted to the range specified under the present invention. If a sponge or other known material traditionally used for such purpose is selected for the base of the cosmetic applicator, the surface of the sponge, etc., is rougher than the surface of the application part of the cosmetic applicator as intended under the present invention, and therefore the roughness of this surface is reduced via processing to within the range of Ra or Rz specified under the present invention.

To this end, a means for filling the surface of the sponge, etc., with coating material or otherwise filling the concaved parts originally present on the surface to adjust the surface roughness to within the range of Ra or Rz under the present invention, a means for softening the sponge surface by heat treatment, etc., and then pressuring the softened surface of the sponge, etc., to lower the projected parts to adjust the surface roughness to within the range of Ra or Rz under the present invention, or a means for preparing a sponge, etc., having extremely fine air bubbles and then cutting the surface of this sponge, etc., flat so that the roughness of the cut surface with fine irregularity falls within the range of Ra or Rz under the present invention, can be adopted.

It is also possible to obtain a cosmetic applicator having the arithmetic average roughness Ra or maximum height Rz under the present invention by pre-adjusting the interior surfaces of molds to meet the range of Ra or Rz under the present invention when the surface of the application part of the cosmetic applicator is formed with resin using the molds, instead of processing the sponge, etc., as mentioned above. Additionally, such cosmetic applicator can be obtained by flow-casting resin solution over a plane whose surface meets the range of Ra or Rz under the present invention and then drying or curing to solidify the solution or form it into shape to manufacture a sheet-like material.

The surface of the application part or sheet-like material obtained by any such method has the irregularity of the interior surfaces of the molds or that of the plane transferred onto it, and therefore a surface of the application part of the cosmetic applicator that meets the desired Ra or Rz can be obtained through a forming process alone.

Furthermore, the formed body or sheet-like material obtained by any such means has a base and the surface of the application part on the face of it.

And, although the surface itself of the obtained formed body, sheet-like material, etc., can be used as a cosmetic applicator, it is also possible to cover the surface of a support with the sheet-like material, etc., having such surface by means of bonding it onto the surface of the support, for example, to use as a cosmetic applicator with its surface serving as the surface of the application part, in which case a sponge or other support material traditionally used for cosmetic applicators can be adopted for this support. In particular, a puff or other cosmetic applicator requiring a certain thickness is manufactured by, for example, attaching a sheet-like material (film-like material) or other application part surface layer onto the surface of a sponge, non-porous elastic body, or other base material.

In addition, a cosmetic tip or other relatively thin cosmetic applicator can be obtained by, for example, attaching a sheet-like material using hot-melt adhesive, etc., onto one side of a sponge or non-porous elastic body exhibiting flexibility made of polyurethane resin, etc.

It is also possible to prepare two laminates, each made by laminating extremely thin sheet-like materials or other application part surface layers of 15 μm or less, or preferably 13 μm or less, or more preferably 11 μm or less in thickness, onto a sponge or other elastic body exhibiting flexibility by means of bonding or thermo-compression bonding, and then attach together the sponges or elastic bodies exhibiting flexibility constituting these laminates either directly or via a support, to obtain a cosmetic applicator having a surface constituting a cosmetic material application part provided on its exterior. Needless to say, a gripping part shaped like a bar, etc., to be pinched with fingers can also be adopted for the support, if necessary.

Note that, particularly in the case of a puff or other cosmetic applicator requiring a certain thickness, or cosmetic tip or other relatively thin cosmetic applicator, as mentioned above, the laminate including the base is attached onto the surface of the cosmetic applicator, if the base material has surface irregularity, so that the surface irregularity of the base and that of the sheet-like material are combined to achieve the specified Ra or Rz under the present invention. If the base has a smooth surface, it is also possible to form the specified R and Rz by means of the surface irregularity of an extremely thin sheet-like material attached on top of the base surface.

Note that, for the means for filling the surface of the sponge, etc., with coating material or otherwise filling the concaved parts originally present on the surface to adjust the surface roughness to within the range of Ra or Rz under the present invention, a means can be adopted that involves applying onto the surface of the base having such concaved parts on the surface a coating solution used as the material for extremely thin sheet-like material, etc., in order to cover the base for the purpose of forming an application part surface layer, and then solidifying the coating solution to fill the concaved parts on the surface of the base, thereby reducing the surface roughness of the application part of the cosmetic applicator thus obtained and consequently achieving the level of Ra or Rz specified under the present invention.

By covering the surface of the base with an extremely thin sheet-like material, etc., as mentioned above, a cosmetic applicator whose application part meets the specification of surface roughness under the present invention can be obtained. In this case, the sheet-like material, etc., itself must have a surface roughness within the range specified under the present invention.

The material constituting the surface of the application part of the cosmetic applicator proposed by the present invention, or material constituting the extremely thin sheet-like material or other surface of the application part, is not limited in any way and an extremely thin sheet-like material formed by polyurethane resin or other flow-cast resin sheet can be used. Needless to say, a foam-like material can be adopted, as well, provided that it is made smooth by filling the concaved parts on the surface with coating material, etc.

The cosmetic applicator proposed by the present invention picks up cosmetic material on its surface and then releases the cosmetic material onto the skin, and is able to release a substantial part of the cosmetic material that has been picked up. Here, as much cosmetic material as possible must be released onto the skin surface, and the user can pick up cosmetic material with the surface of the cosmetic applicator by accurately anticipating how much cosmetic material will be released to the skin surface.

One indicator of how much cosmetic material is released onto the skin is a release ratio obtained by dividing the release amount which is the weight of cosmetic material that has been picked up onto the surface of the cosmetic applicator and subsequently applied to the skin and released onto the skin surface from the cosmetic applicator, by the weight of cosmetic material picked up onto the surface of the cosmetic applicator. Under the present invention, this release ratio is preferably 85.0% or more, or more preferably 88% or more, or even more preferably 90% or more.

The smaller the amount of cosmetic material remaining on the surface of the cosmetic applicator after use, or in other words the higher the release ratio so that more cosmetic material can be released onto the skin surface, the cleaner the applicator surface will remain while the cosmetic applicator remains in storage until the next use, thus preventing growth of bacteria on the surface or accumulation of substances that create stubborn stains.

In particular, the cosmetic applicator proposed by the present invention can be maintained sufficiently clean by, for example, simply wiping it with tissues, without washing, after use.

EXAMPLES

Example 1 and Comparative Examples 1 to 6

Tips made of the respective surface materials shown in Table 1 were prepared and the arithmetic average roughness Ra and maximum height Rz of the surface of each tip were obtained. The arithmetic average roughness Ra and maximum height Rz were obtained by adopting Keyence's Color 3D Laser Microscope VK-8700 as the measuring equipment.

Next, 2 mg of the cream cosmetic material MAQuillAGE Eye Color N (Shiseido) was put on the surface of each tip, or in other words the same amount of cream cosmetic material was put on the surface of each tip, and the cosmetic material was released onto the skin surface. The weight of the used tip was measured to obtain the amount of cosmetic material released onto the skin surface. This measurement was performed five times to obtain an average.

TABLE 1

| | Example 1 | Comparative Example 1 | Comparative Example 2 | Comparative Example 3 | Comparative Example 4 | Comparative Example 5 | Comparative Example 6 |
|---|---|---|---|---|---|---|---|
| Surface material | Urethane film | Silicon | Silicon | Urethane film | Urethane film | Urethane foam | Urethane sheet |
| Surface condition | Flat | Matte | Matte | Irregular | Irregular | Irregular | Irregular |
| | Urethane film 1 | Silicon 1 | Silicon 2 | Urethane film 2 | Urethane film 3 | Urethane foam | Urethane sheet |
| 1st (mg) | 1.8 | 1.3 | 1.4 | 1.4 | 0.9 | 0.8 | 0.9 |
| 2nd (mg) | 1.9 | 1.3 | 1.5 | 1.3 | 1.0 | 0.9 | 1.1 |
| 3rd (mg) | 1.8 | 1.4 | 1.4 | 1.2 | 0.8 | 0.7 | 1.0 |
| 4th (mg) | 1.8 | 1.3 | 1.5 | 1.3 | 1.0 | 0.8 | 1.0 |
| 5th (mg) | 1.8 | 1.3 | 1.4 | 1.3 | 1.1 | 0.7 | 1.1 |
| Average | 1.82 | 1.32 | 1.44 | 1.3 | 0.96 | 0.78 | 1.02 |
| Release ratio (%) | 91 | 66 | 72 | 65 | 48 | 39 | 51 |

Urethane film 1: A tip prepared according to a normal method by bonding a flat urethane film (9 to 10 μm in thickness, Dainichi), using hot-melt adhesive, onto the surface of a dry polyurethane foam (3 mm in thickness) used for regular cosmetic applicators. As shown in Table 2 below, Ra and Rz were measured at 10 arbitrary points on the surface of urethane film 1, and Ra and Rz were confirmed to be 4.67 μm and 60.70 μm, respectively, on average.

The values of Ra and Rz were also obtained for the surface materials used in Comparative Examples 1 to 6 in the same manner.

TABLE 2

| | Ra (μm) | Rz (μm) |
|---|---|---|
| Point 1 | 3.30 | 58.29 |
| Point 2 | 4.77 | 60.61 |
| Point 3 | 5.61 | 61.65 |
| Point 4 | 4.65 | 69.30 |
| Point 5 | 5.52 | 60.67 |
| Point 6 | 3.45 | 53.78 |
| Point 7 | 4.78 | 60.21 |
| Point 8 | 6.71 | 68.22 |
| Point 9 | 3.21 | 54.87 |

TABLE 2-continued

| | Ra (μm) | Rz (μm) |
|---|---|---|
| Point 10 | 4.66 | 59.36 |
| Average | 4.67 | 60.70 |

Silicon 1: A commercially available silicon tip. (Ra 10.13 μm, Rz 339.91 μm)

Silicon 2: A commercially available silicon tip. (Ra 11.58 μm, Rz 254.39 μm)

Urethane film 2: A tip prepared according to a normal method by bonding a urethane film with surface irregularity (16 μm in thickness), using hot-melt adhesive, onto the surface of a dry polyurethane foam (3 mm in thickness) used for regular cosmetic applicators. (Ra 20.39 μm, Rz 210.08 μm)

Urethane film 3: A tip prepared according to a normal method by bonding a urethane film with surface irregularity (18 μm in thickness), using hot-melt adhesive, onto the surface of a dry polyurethane foam (3 mm in thickness) used for regular cosmetic applicators. (Ra 25.14 μm, Rz 384.58 μm)

Urethane foam: A tip constituted by a dry polyurethane foam, whose application part has surface irregularity. (Ra 58.93 μm, Rz 650.05 μm)

Urethane sheet: A tip constituted by a wet polyurethane sheet, whose application part has surface irregularity. (Since this tip has a surface layer manufactured with taffeta fabric used for mold release, its surface roughness is lower than the tips in other Comparative Examples.) (Ra 17.95 μm, Rz 238.48 μm)

According to the above examples, where the same amount of cream cosmetic material was picked up on each tip, Example 1 conforming to the present invention had an extremely high release ratio of 91.0% as calculated by "Release ratio=Released amount/Picked-up amount" (where the picked-up amount represents the amount of cosmetic material picked up onto the surface of the cosmetic applicator, while the released amount represents the amount of cosmetic material that has been picked up onto the surface of the cosmetic applicator and subsequently applied to the skin and released onto the skin surface from the cosmetic applicator), which is clearly superior to the best release ratio among the results of Comparative Examples 1 to 6, or specifically 72.0% exhibited by Comparative Example 2. This release ratio is also higher than the results of Comparative Examples 3 to 6 sharing a common feature with Example 1 in that a urethane material was used. Based on the above, the effects of the present invention are not due to the type of resin of the tip surface, but they are due to the roughness property of the tip surface.

As for Example 2 and Comparative Examples 7 to 9, test conditions more closely simulating the conditions of actual makeup application were used, unlike in the aforementioned example and comparative examples. The user held each cosmetic applicator by hand and picked up cream cosmetic material onto the surface of the application part of the cosmetic applicator, and the picked-up amount of cream cosmetic material was obtained from the difference between the weight of the cosmetic applicator before the pickup and its weight after the pickup.

Since the picked-up amount changes according to how much finger force is applied when the cream cosmetic material is picked up onto the cosmetic applicator, the value was different each time, although the material was the same.

The picked-up amount and released amount were measured by picking up the cream cosmetic material onto the surface of the application part of the cosmetic applicator and then applying the picked-up cosmetic material onto the skin surface, with this process repeated five times consecutively.

Example 2

Using a cosmetic applicator of the same tip shape as in Example 1, the cream cosmetic material MAQuillAGE Eye Color N (Shiseido) was picked up onto the surface of the application part and the picked-up cosmetic material was released onto the skin surface. The weight of the cosmetic applicator was measured before and after the pickup and also after the release, to obtain the amount of cream cosmetic material picked up onto the surface of the application part as well as the amount of cream cosmetic material subsequently released onto the skin surface.

This measurement was repeated five times consecutively for each cosmetic applicator, obtaining the picked-up amount and released amount for each measurement. The picked-up amount and released amount, and the release ratio, are indicated in mg and % below, respectively.

The results are shown in Table 3.

TABLE 3

| | Urethane film 1 (Ra 4.67 μm, Rz 60.70 μm) | | |
|---|---|---|---|
| Use | Picked-up amount | Released amount | Release ratio |
| 1 | 3.2 | 2.9 | 90.6 |
| 2 | 2.9 | 2.7 | 93.1 |
| 3 | 2.9 | 2.6 | 89.7 |
| 4 | 3.1 | 2.9 | 93.5 |
| 5 | 3.3 | 3.0 | 90.1 |
| Ave. | 3.08 | 2.82 | 91.56 |

Comparative Examples 7 to 9

The picked-up amount and released amount were measured in the same manner as in Example 2, except that the cosmetic applicator was changed to a urethane foam in Comparative Example 7, to a urethane sheet in Comparative Example 8, and to silicon 1 in Comparative Example 9.

The results are shown in Tables 4 to 6.

TABLE 4

| (Comparative Example 7) | | | |
|---|---|---|---|
| | Urethane foam (Ra 58.93 μm, Rz 650.05 μm) | | |
| Use | Picked-up amount | Released amount | Release ratio |
| 1 | 7.8 | 1.6 | 20.5 |
| 2 | 3.2 | 1.2 | 37.5 |
| 3 | 6.8 | 3.1 | 45.6 |
| 4 | 3.9 | 1.1 | 28.2 |
| 5 | 3.0 | 1.7 | 56.7 |
| Ave. | 4.94 | 1.74 | 35.22 |

TABLE 5

| (Comparative Example 8) | | | |
|---|---|---|---|
| | Urethane sheet (Ra 17.95 μm, Rz 238.48 μm) | | |
| Use | Picked-up amount | Released amount | Release ratio |
| 1 | 5.8 | 3.7 | 63.8 |
| 2 | 7.4 | 4.9 | 66.2 |
| 3 | 6.6 | 3.8 | 57.6 |
| 4 | 6.2 | 3.2 | 48.5 |
| 5 | 6.9 | 3.0 | 43.5 |
| Ave. | 6.58 | 3.72 | 56.53 |

TABLE 6

| (Comparative Example 9) | | | |
|---|---|---|---|
| | Silicon 1 (Ra 10.13 μm, Rz 339.91 μm) | | |
| Use | Picked-up amount | Released amount | Release ratio |
| 1 | 4.5 | 3.0 | 66.7 |
| 2 | 2.5 | 1.3 | 52.0 |
| 3 | 1.8 | 0.9 | 50.0 |
| 4 | 2.1 | 1.1 | 52.4 |
| 5 | 2.1 | 1.2 | 57.1 |
| Ave. | 2.60 | 1.50 | 57.69 |

Based on the results of Example 2 and Comparative Examples 7 to 9 above, the cosmetic applicator in Example 2 meeting the value ranges of Ra and Rz under the present invention can pick up a similar amount every time, instead of picking up a particularly large amount of cosmetic material or picking up only a small amount of cosmetic material, compared to when the cosmetic applicators in Comparative Examples 7 to 9 are used.

According to Example 2, however, the picked-up amount was 3.08 mg on average, while the released amount was 2.82 mg on average. These results give an extremely high average release ratio of 91.56% calculated by dividing the released amount by the picked-up amount. Accordingly, in light of the released amount the present invention would produce released amounts equivalent to those achieved when other cosmetic applicators capable of picking up a large amount of cosmetic material are used, and when applying cosmetic material onto the skin surface, the present invention can be used in a manner similar to how conventional cosmetic applicators are used.

On the other hand, Comparative Example 7, not meeting the Ra and Rz values under the present invention, resulted in a picked-up amount of 4.94 mg, released amount of 1.74 mg, and clearly lower release ratio of 35.22%.

Similarly, Comparative Example 8 resulted in a picked-up amount of 6.58 mg, released amount of 3.72 mg, and release ratio of 56.53%, while Comparative Example 9 resulted in a picked-up amount of 2.60 mg, released amount of 1.50 mg, and release ratio of 57.69%, showing low release ratios in both cases.

These results are similar to the results of Example 1 and Comparative Examples 1 to 6 above where the same amount of cosmetic material was picked up onto the surfaces of the application parts of the various cosmetic applicators, which indicates that the present invention demonstrates marked effects also due to the actual conditions of use of the cosmetic applicator.

According to the cosmetic applicator proposed by the present invention, the smooth surface of the application part allows cosmetic material to be applied onto the skin surface at a high release ratio, thus reducing the amount of cosmetic material accumulating on the surface of, and inside, the application part of the cosmetic applicator. When the cosmetic applicator is used continuously, any foul smell given off by the accumulated cosmetic material, etc., can be mitigated. After use, the surface of the application part can be wiped clean using tissues, etc., to restore the clean surface before use.

The invention claimed is:

1. A cosmetic applicator comprising an application part for applying a cosmetic material, wherein the application part is formed by an elastic base constituted by a sponge or polyurethane foam, and a sheet made of a polyurethane film with a thickness of 15 μm or less is attached onto a surface of the elastic base, wherein the sheet constitutes the application part's surface, wherein the application part's surface has an arithmetic average surface roughness Ra of 10 μm or less such that the application part's surface picks up the cosmetic material thereon and releases the cosmetic material therefrom to a desired area of skin without the cosmetic material entering an interior of the cosmetic applicator through the sheet.

2. A cosmetic applicator according to claim 1, wherein the application part's surface has a maximum surface height Rz of 80 μm or less.

3. A cosmetic applicator according to claim 2, wherein a release ratio obtained by dividing a release amount which is an amount of cosmetic material that has been picked up onto the surface of the cosmetic applicator and subsequently applied to a skin and released onto the skin surface from the cosmetic applicator, by an amount of cosmetic material picked up onto a surface of the cosmetic applicator, is 85% or more.

4. A cosmetic applicator according to claim 1, wherein a release ratio obtained by dividing a release amount which is an amount of cosmetic material that has been picked up onto the surface of the cosmetic applicator and subsequently applied to a skin and released onto a skin surface from the cosmetic applicator, by an amount of cosmetic material picked up onto the surface of the cosmetic applicator, is 85% or more.

5. A cosmetic applicator comprising an application part for applying a cosmetic material, wherein the application part is formed by an elastic base constituted by a sponge or polyurethane foam, and a sheet made of a polyurethane film with a thickness of 15 μm or less is attached onto a surface of the elastic base, wherein the sheet constitutes the application part's surface, wherein the application part's surface has a maximum surface height Rz of 100 or less such that the application part's surface picks up the cosmetic material thereon and releases the cosmetic material therefrom to a desired area of skin without the cosmetic material entering an interior of the cosmetic applicator through the sheet.

6. A cosmetic applicator according to claim 5, wherein a release ratio obtained by dividing a release amount which is an amount of cosmetic material that has been picked up onto the surface of the cosmetic applicator and subsequently applied to a skin and released onto a skin surface from the cosmetic applicator, by an amount of cosmetic material picked up onto the surface of the cosmetic applicator, is 85% or more.

* * * * *